US005400019A

United States Patent [19]

Riscoe, Jr.

[11] Patent Number: 5,400,019

[45] Date of Patent: Mar. 21, 1995

[54] PORTABLE TRAFFIC LIGHT

[76] Inventor: Alfonso J. Riscoe, Jr., R.D. 1 Box 105, Walton, N.Y. 13856

[21] Appl. No.: 106,992

[22] Filed: Aug. 17, 1993

[51] Int. Cl.[6] ..... G08G 1/095

[52] U.S. Cl. ..... 340/908; 116/63 R; 116/63 P; 340/471; 340/331; 340/332

[58] Field of Search ..... 340/908, 908.1, 471, 340/47.2, 331, 332; 116/63 P, 63 R

[56] References Cited

U.S. PATENT DOCUMENTS 2,591,888 4/1952 Steffen ..... 340/908
3,729,706 4/1973 Hein ..... 340/908
4,401,969 8/1983 Green et al. ..... 340/914
4,535,331 8/1985 Koenig ..... 340/908
4,543,905 10/1985 McKenney ..... 116/63 P
4,616,225 10/1986 Woudenberg ..... 116/63 P

*Primary Examiner*—John K. Peng
*Assistant Examiner*—Daryl C. Pope
*Attorney, Agent, or Firm*—John Maier, III

[57] ABSTRACT

A portable traffic control device for temporary use capable of both automatic and manual operation which portable control device can be raised or lowered by hand and having a horizontal boom which folds down to a vertical position and with an adjustable and collapsible tripod stand and an electrical control circuit.

7 Claims, 2 Drawing Sheets

PORTABLE TRAFFIC LIGHT

BACKGROUND OF THE INVENTION

This invention relates to a traffic control device and more particularly to a portable control device.

Traffic devices of a portable design are required for numerous reasons, the most common of which is for highway construction sites but such devices are also valuable for use where accidents have occurred or where weather conditions have created an unsafe highway condition or where permanent traffic signals have malfunctioned.

Portable traffic control devices are also valuable when special events create a temporary need to control an abnormal heavy traffic flow or where lack of power supply exists.

Portable traffic control devices are found in the prior art. Some, as would be expected are superior to others. One important feature of a portable traffic control device is its ability to place the lights over the roadway and not down on the road surface where they will go undetected by an unsuspecting motorist.

Of greatest importance is to provide a portable traffic light which can be easily transported, put up readily by one person and can be produced economically. In this way, every authority can maintain an inventory of portable traffic lights and readily utilize them as needed.

The alternative to portable traffic control devices is to use flag persons or law enforcement people neither of which may be available. In any event, persons providing traffic directions under such circumstances are frequently placed in danger and often they are not as effective as the use of a traffic control device since in the dark and in inclement weather, a person cannot be as easily noticed as a traffic light.

SUMMARY OF THE INVENTION

Among the several objects and features of this invention is a portable traffic control device which is inexpensive to produce and easily transported and placed in operation as needed.

Other objects and features of this invention will be in part apparent and in part set forth hereinafter.

Briefly stated, a portable traffic light of the present invention has a horizontal boom extending from a vertical mast which is mounted on a tripod. The vertical mast is contractible and the horizontal boom folds down. The tripod base folds down to reduce the size of the device, when not in use, to an elongated device which may be easily transported. A traffic light is detachably mounted on the outer end of the horizontal boom. An electrical circuit provided for operating the light including an electronic programable timer.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
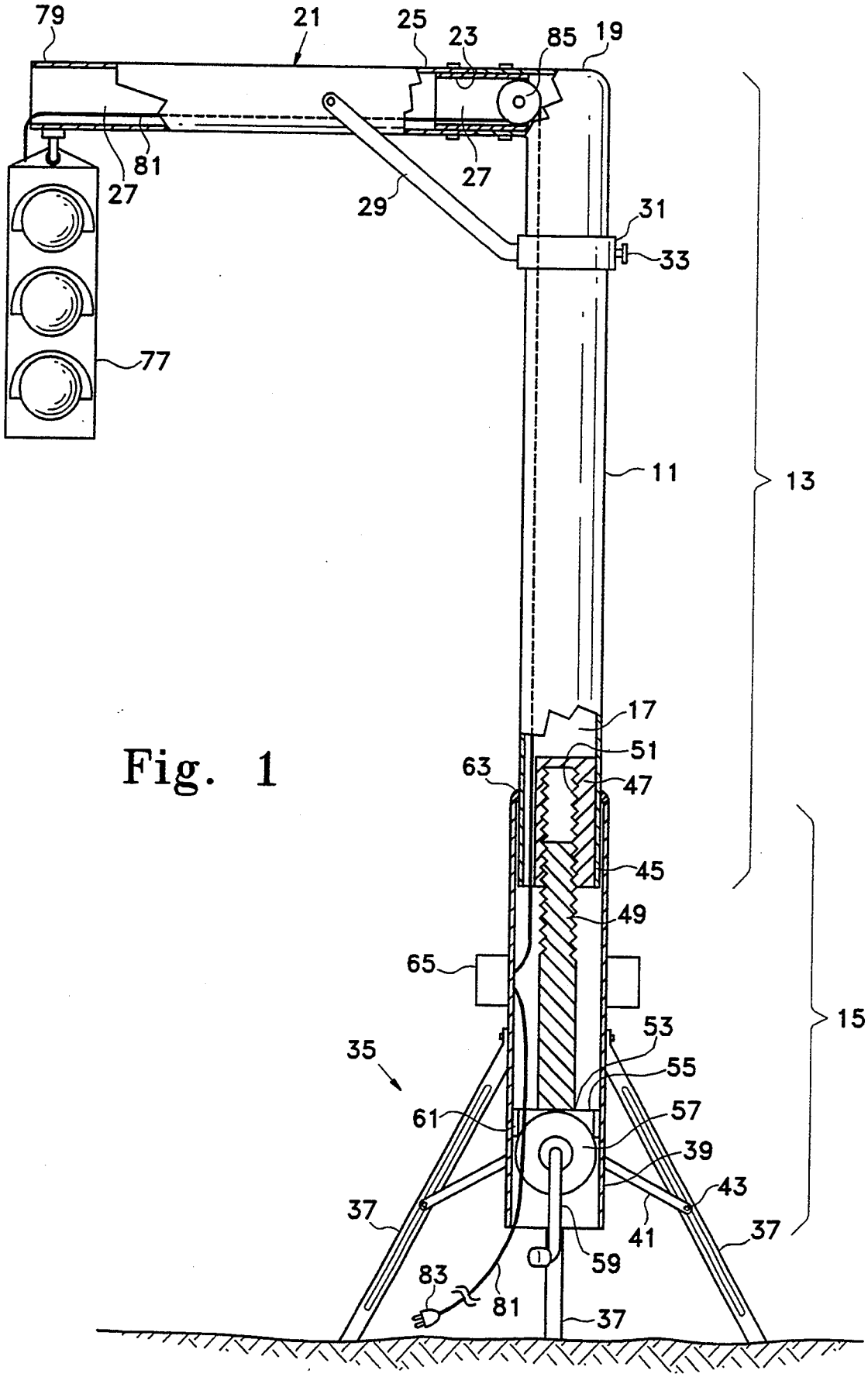
FIG. 1 is a front elevation of the portable traffic light partially broken away showing the portable traffic light in its operating condition.

Referring now to the drawings, a portable traffic light in accordance with the present invention is illustrated in FIG. 1.

The portable traffic light has a vertical mast 11. The vertical mast 11 includes an upper portion 13 and a lower portion 15. The upper portion 13 is slidably mounted in the lower portion 15 and thus is smaller in size. Preferably, both the lower portion 15 and the upper portion 13 have a circular cross section. The vertical mast 11 is, regardless of shape, generally hollow forming a passageway 17.

Extending from the top 19 of the upper portion 13 of the vertical mast 11 is a horizontal boom 21. The horizontal boom has an inner section 23 and an outer section 25.

The inner section 23 of the horizontal boom 21 is rigidly affixed to the top or upper end 19 of the upper portion 13 of the vertical mast 11 and extends only a short distance from the vertical mast 11. The outer section 25 extends substantially further from the inner section 23 than the inner section 23 extends from the vertical mast 11 and is pivotable mounted on the inner section 23. The inner section 23 and the outer section 25 of the horizontal boom 21 are also hollow and preferably have a circular cross section forming a passageway 27 which connects with the passageway 17 of the vertical mast 11.

A cross member 29 extends at an acute angle between the outer section 25 of the horizontal boom 21 and the upper portion 13 of the vertical mast 11. The cross-member 29 is pivotally mounted on the outer section 25 and is slidably mounted on the upper portion 13 by means of a collar 31 which is slidably mounted on the upper portion 13. The cross member 29 is pivotally connected to the collar 31. A turn bolt 33 is threaded into the collar 31 to secure rigidly the collar 31 to the upper portion 13 when the portable signal light is in use.

A tripod base 35 is used to support the vertical mast 11. Three legs 37 are each pivotable mounted at one end toward the lower end or bottom 39 of the vertical mast 11. Supports 41, one for each leg 37, are also pivotally mounted on the vertical mast 11 and pivotally connected at the other end to a slide member 43 slidably mounted on each leg 37. In this way, each leg 37 may be set in a different position from another to accommodate an uneven surface.

Figure 2:
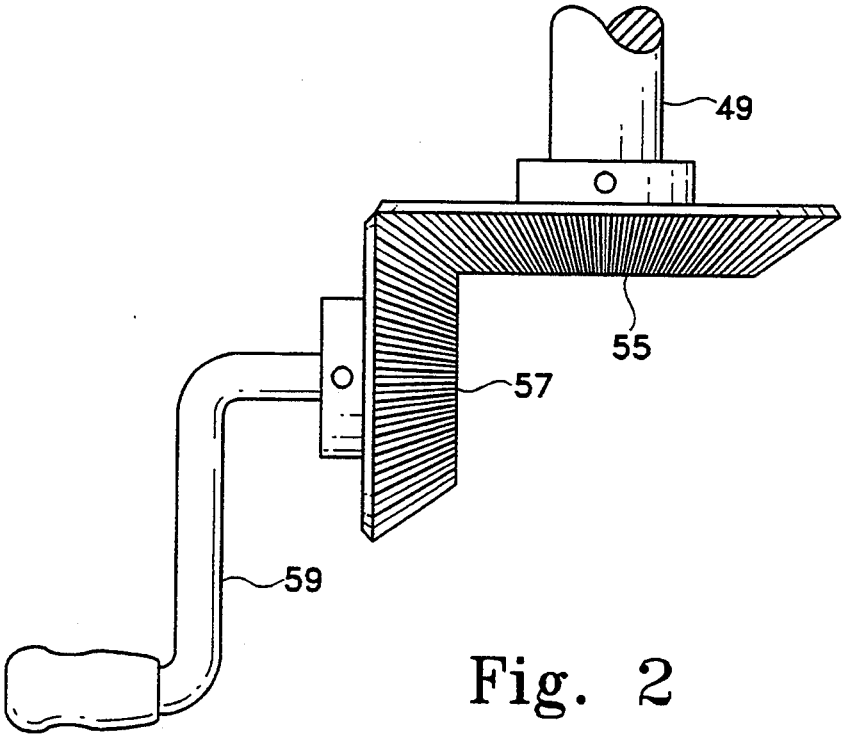
FIG. 2 is a side view of the bevel gears and handle used to elevate and retract the vertical mast.

At the lower end 45 of the upper portion 13 of the vertical mast 11, an internally threaded block 47 is rigidly mounted. A shaft 49 which is threaded at least in part is mounted vertically within the passageway 17 of the lower portion 15 of the vertical mast 11. The shaft 49 engages the internal thread 51 of the internally threaded block 47. The shaft 49, whose lower end is remote from the internally threaded block 47, need not be threaded, but is mounted rotatably in a journal 53 mounted within the lower portion 15 of the vertical mast 11. At the bottom of the shaft 49 a driven bevel gear 55 is securely mounted. A drive bevel gear 57 as best seen in FIG. 2, is mounted on a hand crank 59 which is rotatably mounted within the lower portion 15 of the vertical mast 11 by means of a pair of journals 61. The two bevel 55, 57 gears engage one another and as the hand crank 59 is turned, the shaft 49 turns, moving the upper portion 13 of the vertical mast 11 either up or down depending upon the direction of rotation of the hand crank 59.

A seal 63 is mounted in the top end of the lower portion 15 of the vertical mast 11 to support the upper portion 13 and to protect the passageway 17 of the vertical mast 11 from the weather as the upper portion 13 slides up and down within the lower portion 15.

A control box 65 may be mounted on the outside of the lower portion 15 of the vertical mast 11. Various control circuits may be used, one such circuit being taught by Green et al U.S. Pat. No. 4,401,969 or as provided for hereinafter.

Figure 3:
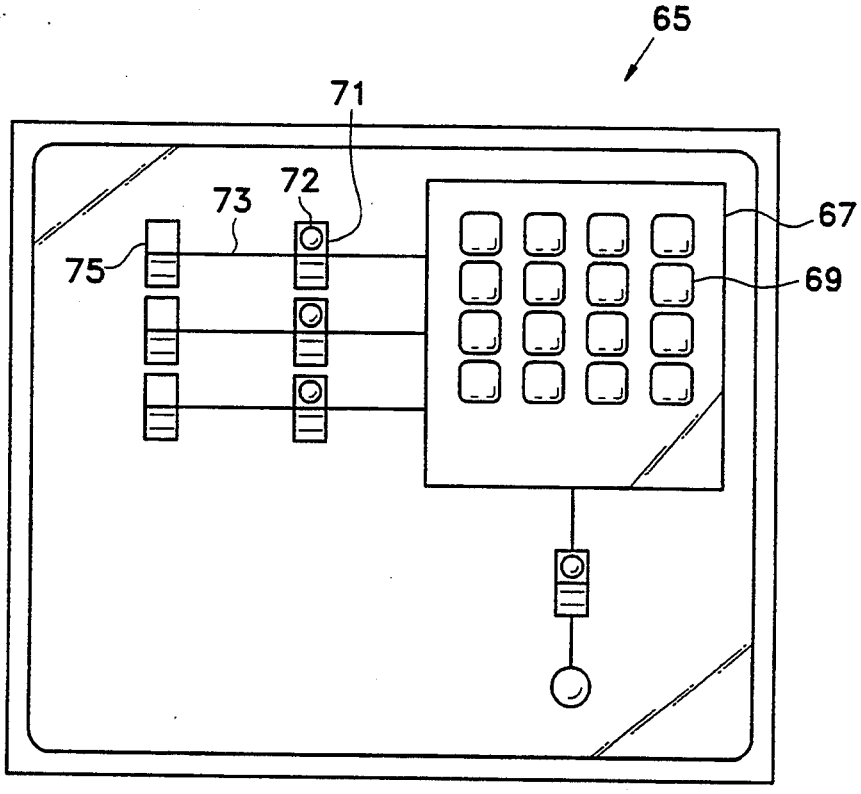
FIG. 3 is a front view of the control box for the electrical controls.

As part of a control circuit, as best can be seen on FIG. 3, the control box 65 includes an electronic programable timer 67. The electronic programable timer 67 would handle three circuits for a time period of seven days. Sixteen buttons 69 would be provided on the electronic programable timer 67. Preferably, the sixteen buttons 69 would be of L.E.D. design for low light conditions. Repeat programming would provide up to one hundred ninety six operations per week. Time settings would be from thirty seconds to seven days per circuit.

Each of the three circuits would include an on/off switch 71 with a status lamp 72 and a flashing relay 73 with an on/off switch 75 that would be provided for each circuit.

A traffic control light 77 is suspended by any suitable means such as a hook and eye from the outer end 79 of the horizontal boom 21.

Electrical power is supplied from a source (not shown) such as a portable generator or alternator or a battery and the power cord 21 enters the lower portion 15 of the vertical mast 11 and connects to the control box 65. The power cord 81 extends through the vertical mast 11 to the horizontal mast through the passageway in the vertical 11 mast and the passageway 27 in the horizontal boom 21.

The power cord 81 extends from the horizontal boom 21 near its outer end 79 to connect to the traffic control light 77. The power cord 81 is extended through the passageway 27 in the horizontal boom 21 and the passageway 17 in the vertical mast 11 to the control box 65 and is extended down from the control box 65 to near the lower end 45 of the lower portion 15 with an additional extension and plug 83 for easy connection to the power source. The on/off switch 71 with a status lamp 72 is provided in the power cord 81 between the electronic programmable timer 67 and the plug 83 for connection to the power source.

When the horizontal boom 21is lowered there is an adequate length of power cord 81 to permit the horizontal boom 21 to be lowered without pulling the power cord 81. When the vertical mast 11 is lowered however, the length of the power cord 81 in the vertical 11 mast needs to be reduced to avoid bunching up of the power cord 81. Accordingly, a spring-loaded spool 85 is rotatally mounted where the inner section 23 of the horizontal boom 21 is rigidly affixed to the upper end 19 of the upper portion 13 of the vertical mast 11. As the vertical mast 11 is raised the spring-loaded spool 85 unwinds the power cord 81. As the vertical mast 11 is lowered, the spring-loaded spool 85 rewinds the power cord 21. The power cord 81 from the traffic control light 77 to the spring-loaded spool is affixed to the spring-loaded spool 85 so as to connect with the power cord 81 wound on the spring-loaded spool 85.

To erect the portable traffic light, the legs 37 of the tripod base 35 are pulled out and the portable traffic control device is placed down on the legs 37. Since each leg 37 may be separately adjusted, the unit may be placed upon an uneven surface or flat bed mounted.

The horizontal boom 21 is swung approximately ninety degrees to a horizontal position from the vertical position. The turn bolt 33 is turned down to hold the collar 31 in place. Any suitable means may be used in place of the turn bolt 33 to hold the horizontal boom 21 in place. The traffic control light 77 mounted on the horizontal boom 21 and connected to the power end 81. The traffic control light 77 is mounted in the horizontal boom 21 while the vertical mast 11 is still retracted. The hand crank 59 is turned thereby moving the upper portion 13 of the vertical mast 11 to its extended position. The power end is connected to a suitable power source and the portable traffic control device is ready to operate.

The portable traffic control device is dismantled by reversing the steps used to erect the portable traffic control device.

As various changes could be made in the above constructions without departing from the scope of the invention, it is intended that all matter contained in the above description or shown on the accompanying drawings should be interpreted as illustrative and not in a limiting sense.

What is claimed is:

1. A portable traffic control device comprising:

A vertical mast with an upper end and a lower end and an upper portion and a lower portion, the upper portion being slidably mounted in the lower portion;

A horizontal boom having an inner end and an outer end and an outer section and an inner section, the length of the inner section being substantially less than the length of the outer section, the inner section being rigidly affixed to the upper end of the upper portion of the of the vertical mast, and the outer section being pivotally connected to the inner section;

A tripod base located on the lower end of the vertical mast;

Means for holding the outer section in a horizontal position including a collar slidably mounted on the upper portion and a cross member extending at an acute angle between the outer section of the horizontal boom and the upper portion of the vertical mast, the cross member being pivotally mounted on the outer section and being pivotally mounted on the collar, the collar including means to affix the collar to the upper portion;

A hand crank means for raising and lowering the upper portion of the vertical mast;

A traffic light detachably mounted on the outer end of the horizontal boom; and

Electrical means for operating the traffic light.

2. A portable traffic light according to claim 1 wherein the hand crank means for raising and lowering the upper portion of the vertical mast includes:

A block rigidly mounted in the lower end of the upper portion of the vertical mast, the block having an opening in it, said opening having an internal thread;

A shaft having an upper end and a lower end rotatably vertically mounted in the lower portion of the horizontal boom, the shaft having an external thread at its upper end which engages the internal thread of the opening;

A driven bevel gear mounted on the lower end of the shaft;

A hand crank rotatably mounted in the lower portion of the vertical mast; and

A drive bevel gear mounted on the hand crank, the drive bevel gear engaging the driven bevel gear.

3. A portable traffic light according to claim 1 wherein the electrical means for operating the traffic light includes An electrical power cord extending from the traffic light through the horizontal boom and the vertical mast from the traffic light to the lower end of the vertical mast;

A control means, the electrical power cord being connected to the control means; and A power source connected to the power cord.

4. A portable traffic light according to claim 1 further including:

An electrical power cord and a spring-loaded spool rotatably mounted in the horizontal boom and the vertical mast where the inner section of the horizontal boom is affixed to the vertical mast, the electrical power cord extending from the traffic light to the spool.

5. A portable traffic light according to claim 1 wherein the electrical means for operating the traffic light includes:

An electrical power cord extending from the traffic light through the horizontal boom and the vertical mast from the traffic light to the lower end of the vertical mast;

A control means, the control means including an electronic programmable timer, the electrical power cord being connected to the control means; and A power source connected to the power cord.

6. A portable traffic light comprising:

A vertical mast with an upper end and a lower end and an upper portion and a lower portion, the upper portion being slidably mounted in the lower portion, the vertical mast having a passageway through it;

A horizontal boom having an inner end and an outer end and an outer section and an inner section, the length of the inner section being substantially less than the length of the outer section, the inner section being rigidly affixed to the upper end of the upper portion of the vertical mast and the outer section being pivotally mounted on the inner section, the horizontal boom having a passageway through it which connects with the passageway in the vertical mast;

A collar slidably mounted on the upper portion;

A cross member extending at an acute angle between the outer section of the horizontal boom and the upper portion of the vertical mast, the cross member being pivotally mounted on the outer section and being pivotally mounted on the collar, the collar including means to affix the collar to the upper portion;

A tripod base located on the lower end of the vertical mast, the tripod base including three legs generally equally spaced circumferentially about the vertical mast, each leg being pivotally mounted on the vertical mast adjacent to the lower end, a support member having two ends, one being slidably mounted at one end on each leg and being pivotally mounted at the other end on the vertical mast;

A block rigidly mounted in the lower end of the upper portion of the vertical mast, the block having an opening through it, said opening having an internal thread;

A shaft having an upper end and a lower end rotatably mounted in the lower portion of the horizontal boom, the shaft having an external thread at its upper end which engages the internal thread of the opening, said shaft being generally vertically oriented;

A driven bevel gear mounted on the lower end of the shaft;

A hand crank rotatably mounted in the lower portion of the vertical mast;

A drive bevel gear mounted on the hand crank, the drive bevel gear engaging the driven bevel gear;

A traffic light;

Means for mounting the traffic light on the outer end of the horizontal boom;

An electical power cord extending from the traffic light through the passageway of the horizontal boom and the passageway of the vertical mast and outside the lower end of the vertical mast;

A control means mounted on the vertical mast; the electrical power cord being connected to the control means; and A power source connected to the power cord.

7. A portable traffic light according to claim 6 wherein the control means includes an electronic progammable timer.

* * * * *